US007878226B2

(12) United States Patent
Ansaloni et al.

(10) Patent No.: US 7,878,226 B2
(45) Date of Patent: Feb. 1, 2011

(54) MACHINE FOR FILLING CONTAINERS WITH AT LEAST ONE GRANULAR PRODUCT

(75) Inventors: Angelo Ansaloni, Crespellano (IT); Davide Frabetti, Baricella (IT)

(73) Assignee: MG 2 - S.r.l., Pianoro (IT)

( * ) Notice: Subject to any disclaimer, the term of this patent is extended or adjusted under 35 U.S.C. 154(b) by 930 days.

(21) Appl. No.: 11/804,216

(22) Filed: May 16, 2007

(65) Prior Publication Data

US 2007/0284015 A1 Dec. 13, 2007

(30) Foreign Application Priority Data

May 16, 2006 (EP) ..... 06425331

(51) Int. Cl.
*B65B 43/42* (2006.01)

(52) U.S. Cl. ..... 141/147; 141/81; 141/129; 141/144; 141/145; 141/146

(58) Field of Classification Search ..... 141/2, 141/12, 71, 81, 129, 144–147; 53/202, 467, 53/473

See application file for complete search history.

(56) References Cited

U.S. PATENT DOCUMENTS 3,565,132 A * 2/1971 Lefort ..... 141/147
4,163,354 A * 8/1979 Austin ..... 53/436
5,320,146 A * 6/1994 Stevie ..... 141/1
5,855,233 A * 1/1999 Bolelli ..... 141/144
6,390,330 B2 * 5/2002 Runft ..... 222/41
6,425,422 B1 * 7/2002 Trebbi ..... 141/67
7,210,507 B2 * 5/2007 Facchini ..... 141/146

FOREIGN PATENT DOCUMENTS

EP 0 186 502 A2 7/1986
WO WO 03/094824 A 11/2003

OTHER PUBLICATIONS

European Search Report for EP 06 42 5331 dated Nov. 1, 2006.

* cited by examiner

*Primary Examiner*—Timothy L Maust
(74) *Attorney, Agent, or Firm*—Bryan A. Santarelli; Graybeal Jackson LLP

(57) ABSTRACT

In an embodiment of a continuously-operating machine for filling containers with at least one granular product, each container is fed along a given path in time with a relative metering device, which withdraws the product from a tank, feeds the withdrawn product into the container, and has a metering cylinder defined at the bottom by a piston which moves, along the metering cylinder, to and from a feed position in which to feed the product in the metering cylinder to a drop chute for unloading the product into the relative container; the piston having a cam follower which is maintained contacting a cam by a pneumatic push assembly.

9 Claims, 14 Drawing Sheets

MACHINE FOR FILLING CONTAINERS WITH AT LEAST ONE GRANULAR PRODUCT

PRIORITY CLAIM

This application claims priority from European patent application No. 06425331.3, filed May 16, 2006, which is incorporated herein by reference.

TECHNICAL FIELD

An embodiment of the present invention relates to a machine for filling containers with at least one granular product.

More specifically, an embodiment of the present invention relates to a machine for filling capsules with a pharmaceutical product in the form of granules, to which the following description refers purely by way of example.

BACKGROUND

In the pharmaceutical industry, a machine is used to fill capsules with a granular pharmaceutical product, and which comprises a conveyor device moving continuously along a given path and having a number of pockets, each for receiving a respective bottom shell of a respective capsule; at least one container for the product; and a metering wheel mounted to rotate continuously about a substantially vertical longitudinal axis.

The metering wheel has a number of metering devices, each of which travels with the metering wheel along a portion of said path, in time with a respective bottom shell, to withdraw the product from the container and feed the product into the bottom shell.

Each metering device comprises a metering cylinder for receiving the product from the container; a drop chute for unloading the product in the metering cylinder into a respective bottom shell; and a piston which defines the bottom of the metering cylinder, and is moved along the metering cylinder, to and from a feed position to feed the product to the drop chute, by a cam follower roller on the piston engaging a cam.

Known machines of the above type have several drawbacks, mainly on account of engagement of the cam by the cam follower rollers moving each piston into the feed position to feed the product to the relative drop chute, regardless of whether the corresponding pocket on the conveyor device contains a bottom shell or not.

Another drawback of known machines of the above type is that, when using two containers containing different granular products, engagement of the cam by the cam follower rollers may not allow for selectively metering the product of only one of the containers into the bottom shells.

SUMMARY

An embodiment of the present invention is a machine for filling containers with at least one granular product, designed to eliminate the aforementioned drawbacks.

BRIEF DESCRIPTION OF THE DRAWINGS

One or more non-limiting embodiments of the present invention will be described by way of example with reference to the accompanying drawings.

DETAILED DESCRIPTION

Figure 1:
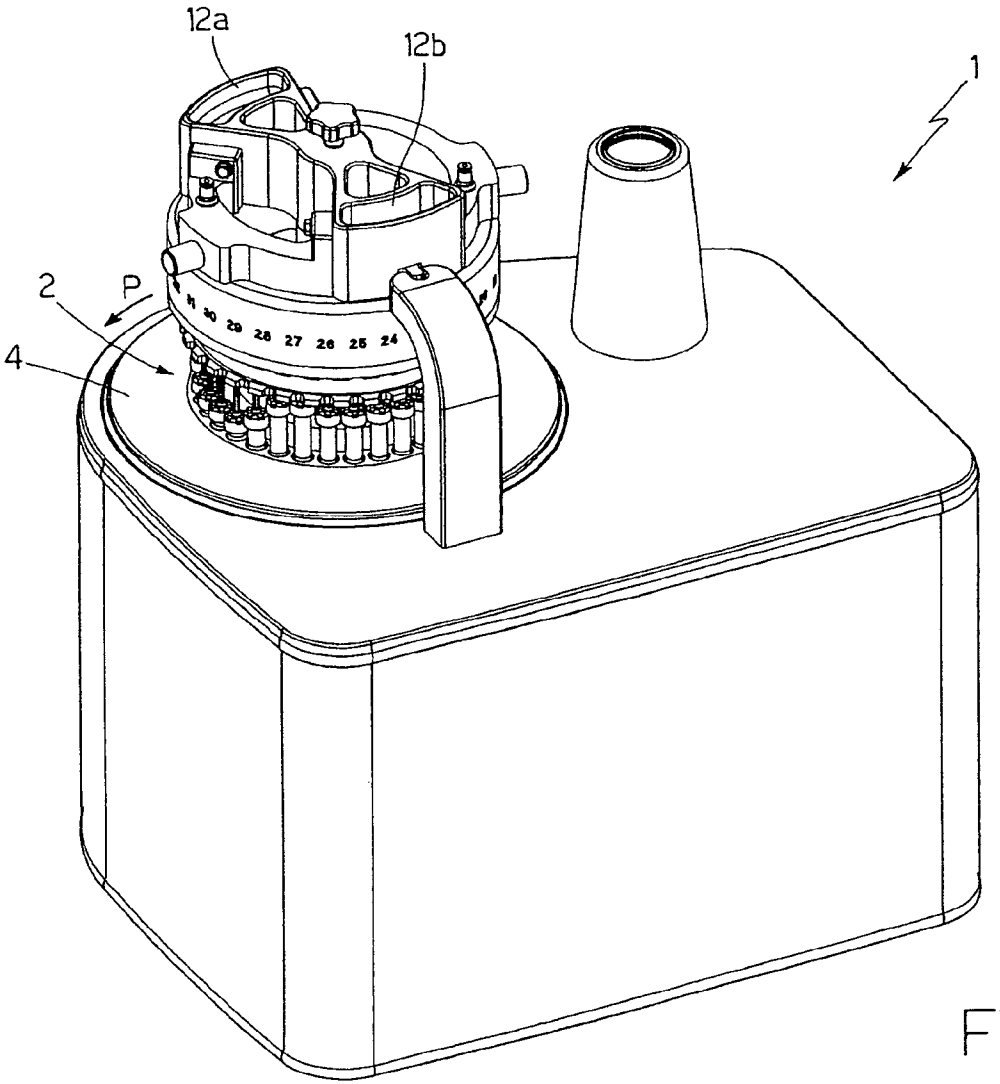
FIG. 1 shows a schematic view in perspective of an embodiment of the machine according to the present invention.

With reference to FIGS. 1 and 5, number 1 indicates as a whole an embodiment of a machine for filling known capsules (not shown) with at least one granular pharmaceutical product. Each capsule (not shown) comprises a substantially cup-shaped bottom shell F, and a top shell (not shown) fitted to bottom shell F.

Machine 1 comprises a metering wheel 2, in turn comprising a supporting shaft (not shown), which has a substantially vertical longitudinal axis 3, is fitted in rotary manner to a fixed frame 4 of machine 1, is rotated continuously about axis 3 and with respect to frame 4 by a known actuating device not shown, and supports a top metering drum 5.

Drum 5 comprises a bottom plate 6 perpendicular to axis 3 and fitted in angularly fixed manner to said supporting shaft (not shown); and an annular top plate 7 fixed, coaxially with axis 3, to a top edge of plate 6.

A sprocket 8 is formed on the outer surface of plate 6, is coaxial with axis 3, and forms part of a known conveyor device 9 for feeding each bottom shell F along a given path P. Device 9 comprises a chain conveyor 10 looped about a number of powered sprockets (of which only sprocket 8 is shown in FIGS. 5 and 6) and having a number of pockets 11, which are substantially cup-shaped with their concavity facing upwards, are equally spaced along conveyor 10, are fed continuously along path P by conveyor 10, and each of which receives a respective bottom shell F with its concavity facing upwards.

In the example shown, frame 4 is fitted with two tubular containers 12*a*, 12*b*, which are mounted on plate 7, are axially open, are arranged about axis 3, and each of which extends a respective given angle about axis 3, and contains a respective granular pharmaceutical product.

Drum 5 has a number of (in the example shown, thirty-two) metering devices 13 equally spaced about axis 3 and fed continuously about axis 3 by wheel 2. Each device 13 is fed by wheel 2, in time with a respective pocket 11, along a portion of path P, so as to normally withdraw a given quantity of pharmaceutical product from each container 12*a*, 12*b*, and to feed the withdrawn pharmaceutical products into respective bottom shell F.

Each device 13 comprises a metering cylinder 14, which extends through plates 6 and 7, has a longitudinal axis 15 parallel to axis 3, is offset radially with respect to relative pocket 11, and is connected to relative pocket 11 by a sloping drop chute 16 formed through plate 7.

Cylinder 14 is closed at the bottom by the top end of a piston 17, which is mounted coaxially with axis 15, is bounded at the top by a flat surface 18 sloping with respect to axis 15, is fitted in axially-sliding manner to drum 5, and is moved back and forth linearly, with respect to drum 5 and under the control of an actuating device 19, in a direction 20 parallel to axes 3 and 15.

Device 19 comprises a cam 21, which extends about axis 3, is common to pistons 17 of all the metering devices 13, and in turn comprises a top track 22 and a bottom track 23 facing each other, and a cam follower roller 24 carried by piston 17 and engaging cam 21. At each container 12*a*, 12*b*, cam 21 comprises a first portion 25 (FIGS. 5*a*-5*d* and 6*a*-6*d*) where the distance, measured parallel to direction 20, between tracks 22 and 23 is greater than the diameter of a roller 24; and a second portion 26 (FIGS. 5*e* and 6*e*) where the distance between tracks 22 and 23 substantially equals the diameter of a roller 24.

At portions 25, rollers 24 are kept in contact with tracks 22 and 23 by a pneumatic push device 27 comprising an annular drum 28, which is mounted coaxially with axis 3, is fitted in angularly fixed manner to said supporting shaft (not shown) to rotate continuously about axis 3, is bounded at the bottom by a flat surface 29 substantially perpendicular to axis 3, and has a number of cavities 30, which are equal in number to cylinders 14, are equally spaced about axis 3 with the same spacing as cylinders 14, are each coaxial with a respective axis 15, and open outwards at surface 29.

Cavities 30 are closed at the bottom by an annular distributor disk 31 fitted in angularly fixed manner to drum 28 to rotate continuously about axis 3, and which, in contact with surface 29 and together with cavities 30, defines a number of actuating cylinders 32, in each of which slides the bottom end of a respective piston 17 which thus defines the output rod of respective cylinder 32 and, inside respective cylinder 32, a cylindrical bottom chamber 33 and an annular top chamber 34.

At portions 25 of cam 21, chambers 34 normally communicate with a known compressed-air pneumatic device (not shown) via a pneumatic circuit 35 comprising an annular header 36 fixed to frame 4 and coaxial with axis 3, and, for each chamber 34, a respective radial conduit 37 formed through drum 28 and connected in fluidtight manner to header 36.

At portions 25 of cam 21, chambers 33 communicate selectively with said pneumatic compressed-air device (not shown) via a pneumatic circuit 38 formed partly in distributor disk 31 and partly in a feed disk 39 fixed to frame 4 underneath and facing disk 31.

Figure 2:
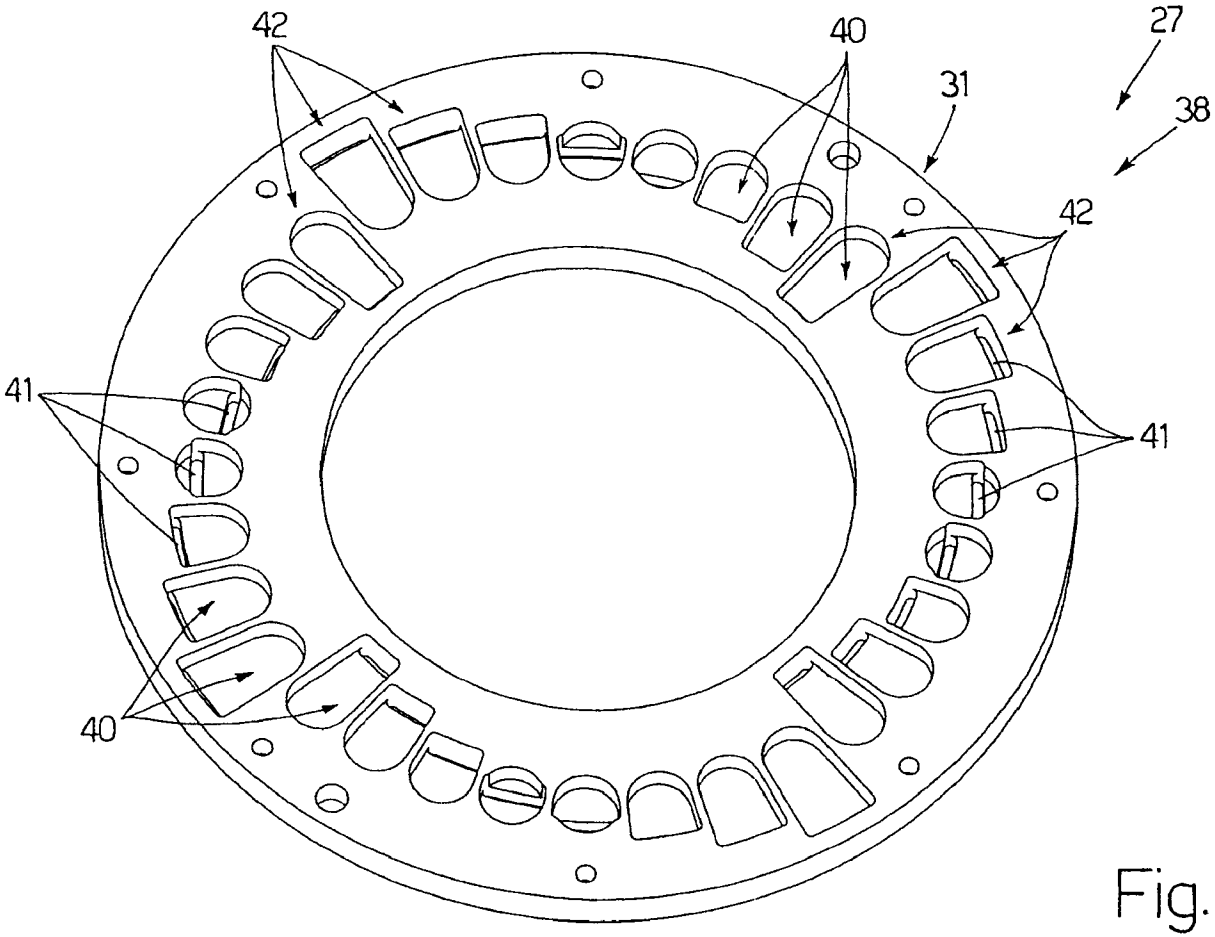
FIG. 2 shows a schematic view in perspective of a first detail of the FIG. 1 machine.

As shown in FIG. 2, for each metering device 13, and therefore for each chamber 33, disk 31 comprises a respective contoured cavity 40, which is formed in disk 31, parallel to direction 20, is positioned facing, to communicate pneumatically with, relative chamber 33, and has a slit 41 formed through disk 31, parallel to direction 20, and extending a given angle about axis 3.

In connection with the above, it should be pointed out that, in the example shown:

the thirty-two slits 41 are divided into eight groups 42 of slits 41, each comprising four circumferentially aligned slits 41 equally spaced about axis 3;

slits 41 in each group 42 of slits 41 alternate with slits 41 in the other groups 42 of slits 41; and slits 41 in each group 42 of slits 41 are offset both radially and circumferentially with respect to slits 41 in the other groups 42 of slits 41.

Figure 3:
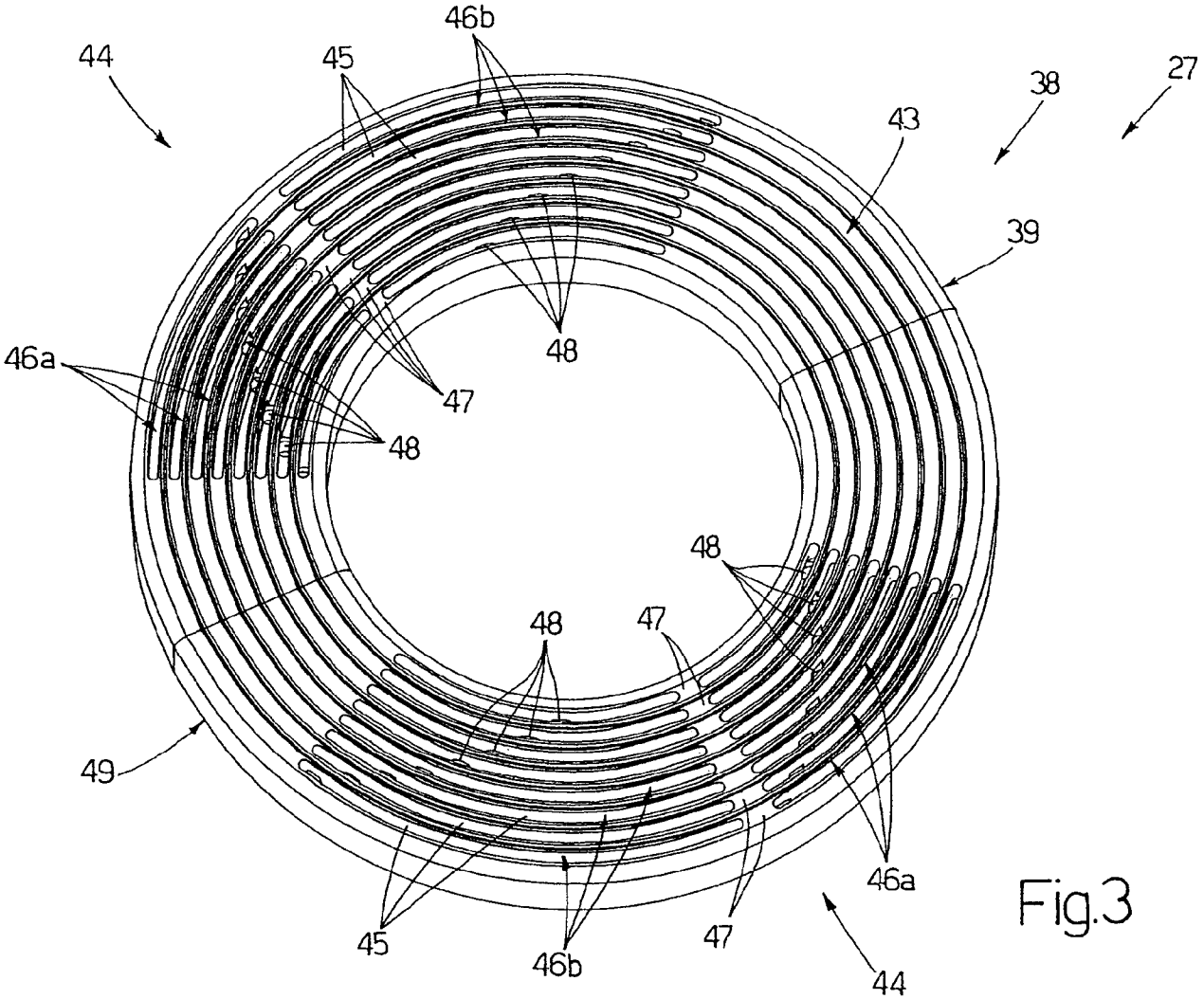
FIG. 3 shows a schematic view in perspective of a second detail of the FIG. 1 machine.

With reference to FIG. 3, feed disk 39 is bounded axially by a top surface 43 perpendicular to axis 3, is positioned with surface 43 contacting distributor disk 31, and has two groups 44 of feed channels 45 extending about axis 3 and each associated with one of containers 12*a*, 12*b*.

Figure 4:
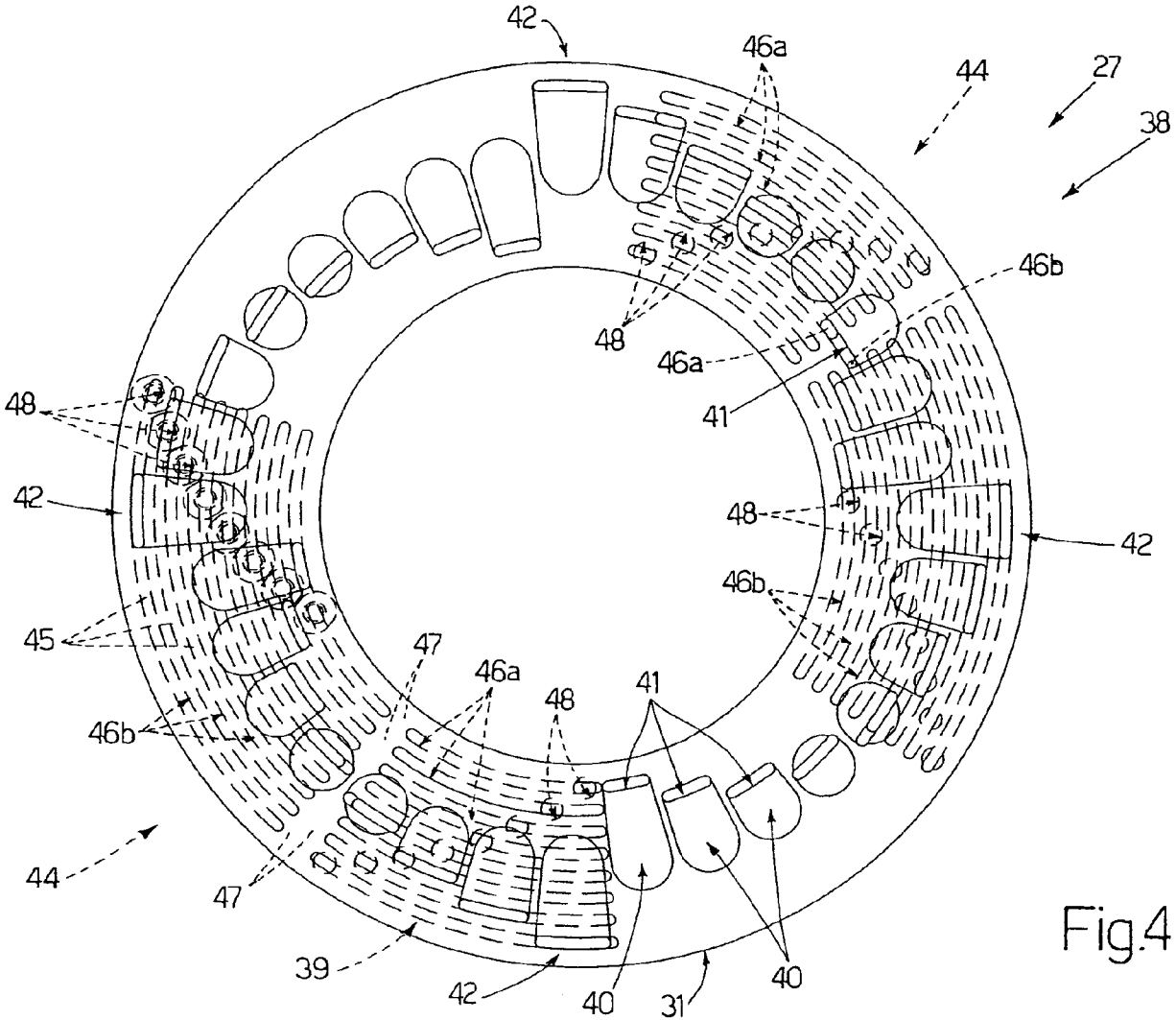
FIG. 4 shows a plan view of the FIGS. 2 and 3 details.

Channels 45 in each group 44 of channels 45 are aligned radially, open outwards at surface 43, and extend less than 180° about axis 3. As disk 31 rotates about axis 3, each channel 45 is engaged by slits 41 in a group 42 of slits 41 (FIG. 4).

Each channel 45 comprises two circumferentially aligned portions 46*a*, 46*b* separated by a portion 47 of surface 43, which cooperates with disk 31 to separate portions 46*a*, 46*b* in fluidtight manner, and is of a circumferential width smaller than the circumferential width of slits 41 associated with channel 45.

Each portion 46*a*, 46*b* has a conduit 48, which extends through disk 39, parallel to direction 20, opens outwards at a bottom surface 49 of disk 39, parallel to and opposite surface 43, is offset both radially and circumferentially with respect to conduits 48 of the other portions 46*a*, 46*b*, and is connected to said pneumatic compressed-air device with the interposition of a solenoid valve 50.

Operation of machine 1 will now be described with reference to FIG. 5, with reference to the filling of one bottom shell F with the pharmaceutical product in container 12*a*, and as of the instant in which (FIG. 5*a*):

the bottom shell F considered and the relative metering device 13 have been moved, in time with each other, into position beneath container 12*a;* the relative cam follower roller 24 engages the portion 25 of cam 21 associated with container 12*a*, so that the compressed air fed into top chamber 34 by pneumatic circuit 35 moves piston 17 downwards, so that roller 24 engages bottom track 23;

the pharmaceutical product in container 12*a* is fed by force of gravity into relative metering cylinder 14; and relative channel 45 is disconnected from said pneumatic compressed-air device (not shown) by relative solenoid valve 50.

Figure 5A:
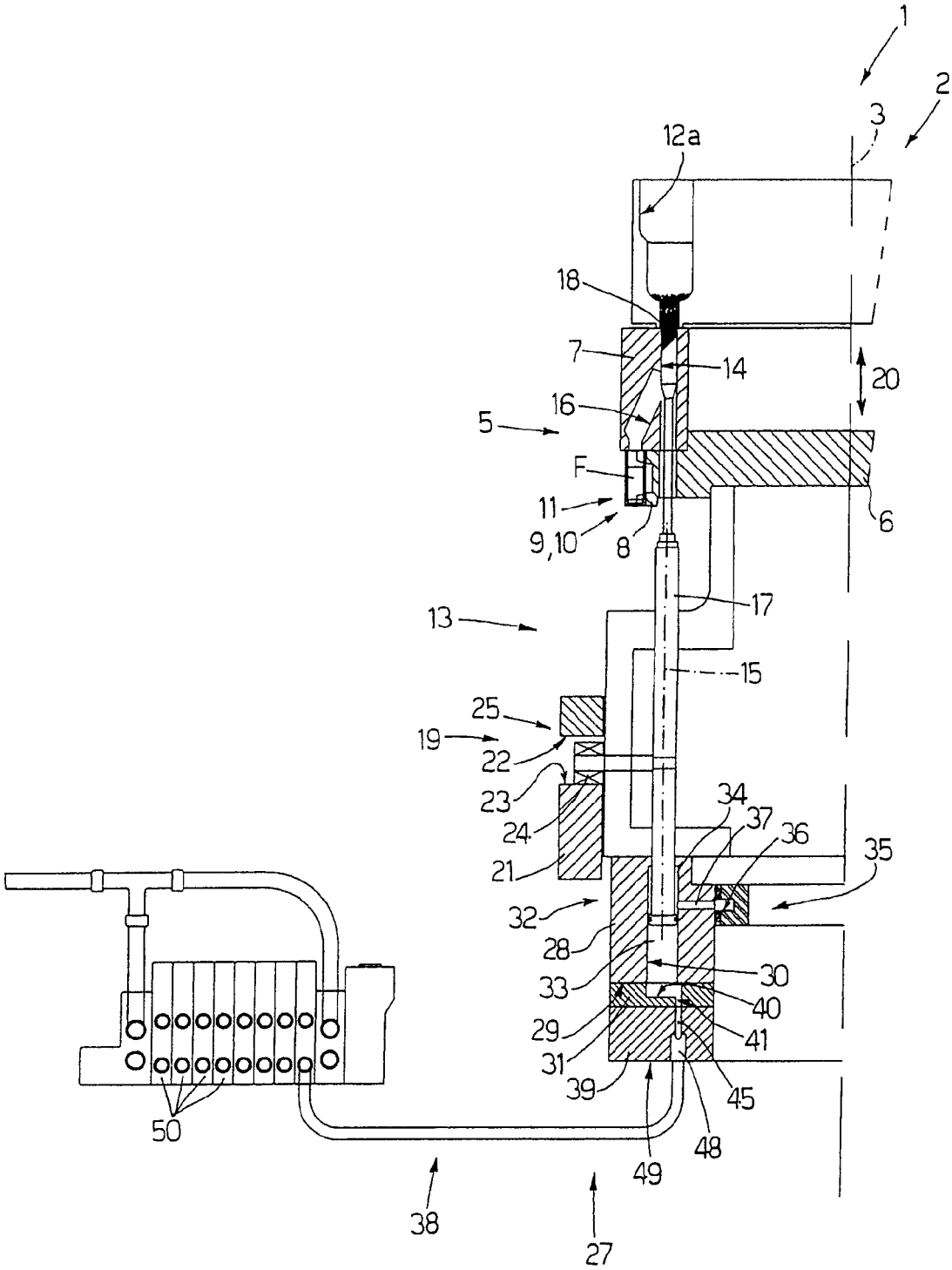
FIGS. 5*a*-5*e* show, schematically, a first operating mode of the FIG. 1 machine.
Figure 5B:
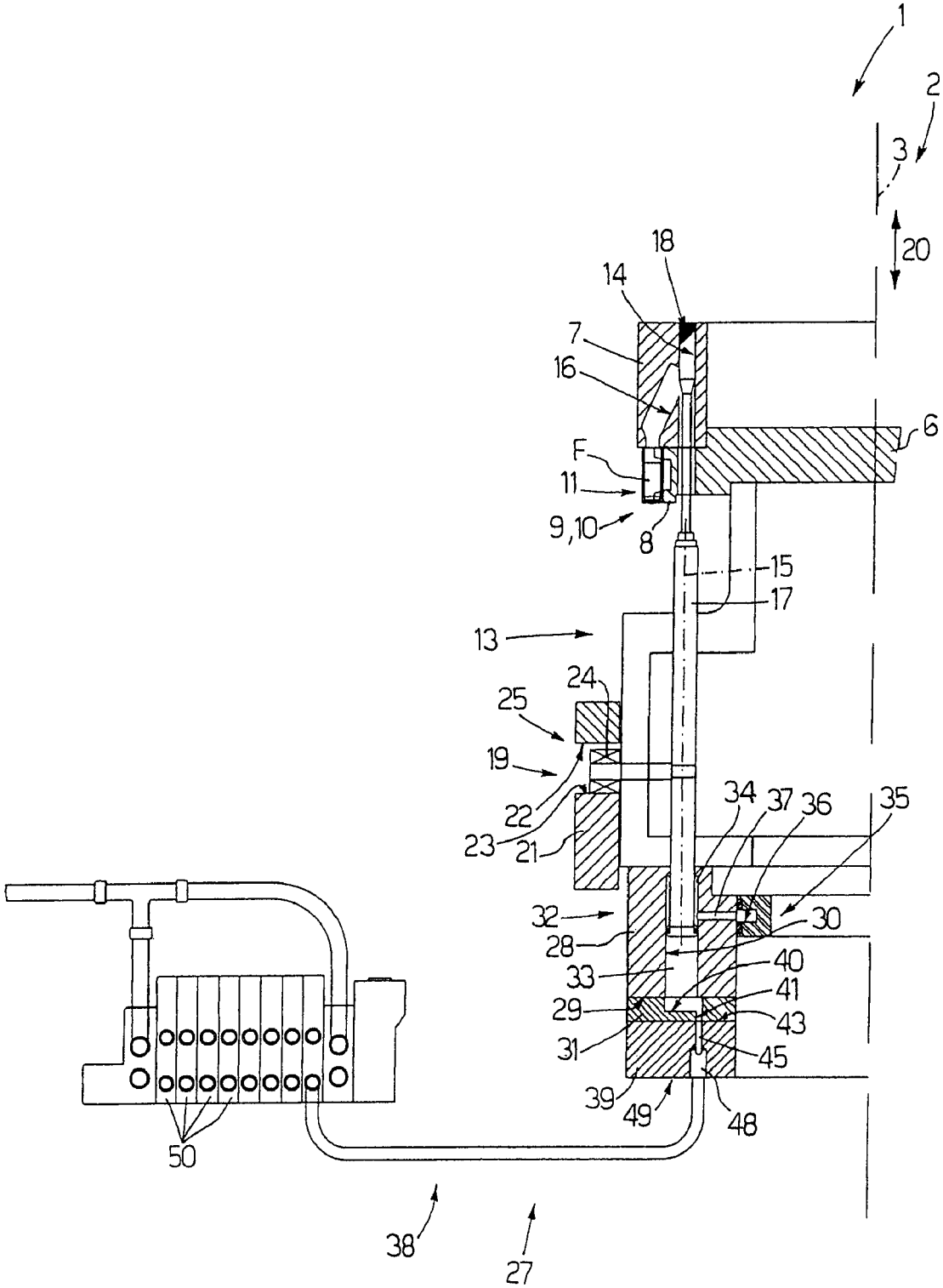
Figure 5C:
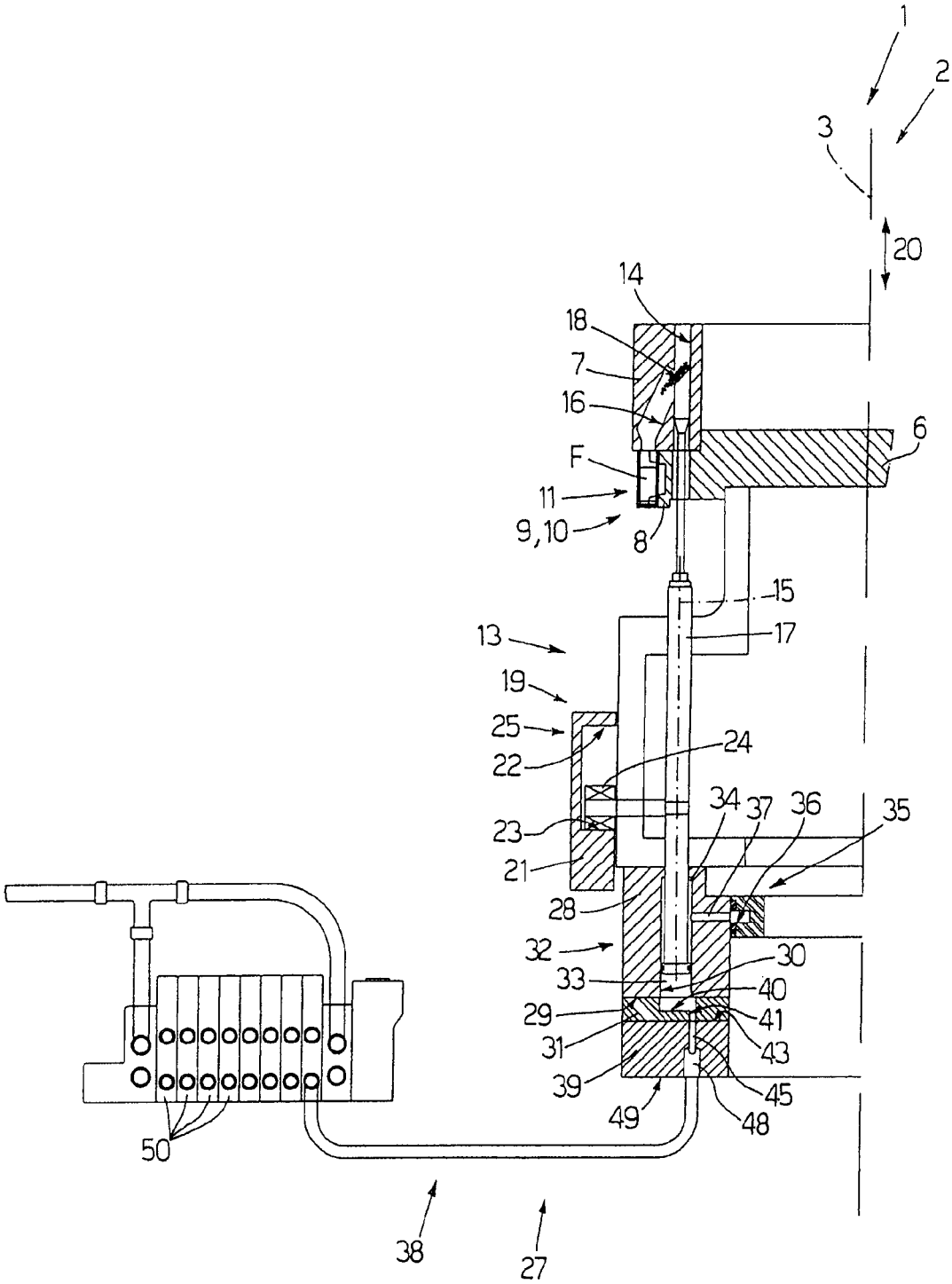
Figure 5D:
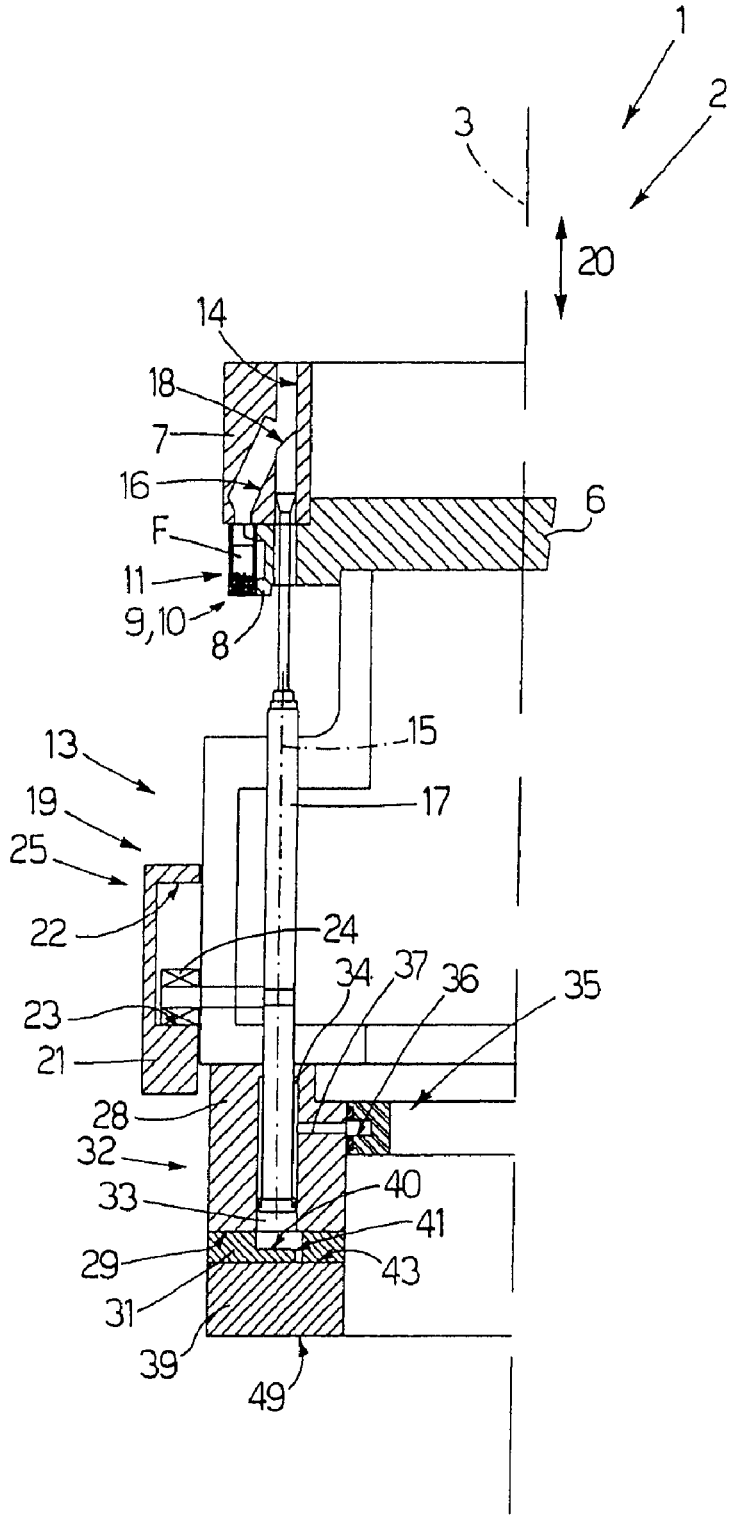
Figure 5E:
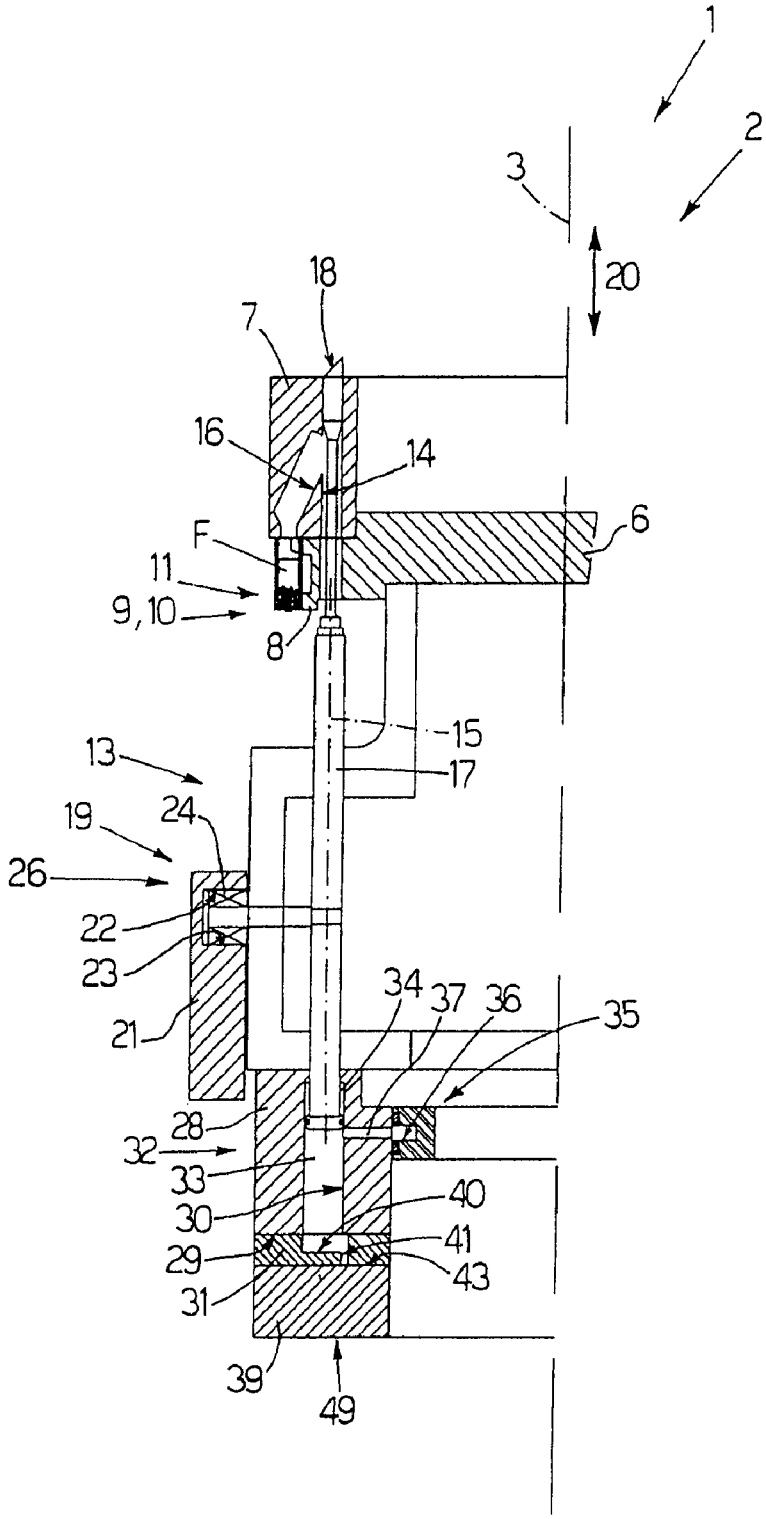

As it rotates about axis 3, device 13 disengages container 12*a* with a given quantity of pharmaceutical product inside cylinder 14 (FIG. 5*b*), and piston 17 is lowered into a feed position in which to feed the pharmaceutical product along drop chute 16 into bottom shell F (FIGS. 5*c* and 5*d*). At this point, the movement of piston 17 in direction 20 is guided by portion 26 of cam 21 associated with container 12*a*, and piston 17 is first raised above conduit 37 so as to project upwards from cylinder 14 and expel any granules still inside cylinder 14 (FIG. 5*e*), and is then moved back down below conduit 37 (FIG. 5*a*) to repeat the operating sequence described at container 12*b*.

An advantage of machine 1 lies in pneumatic push device 27 selectively controlling operation of each metering device 13, and preventing supply of the pharmaceutical product from either both containers 12*a*, 12*b*, in the event metering cylinders 14 are advanced in time with relative pockets 11 having no bottom shells F, or from one of containers 12*a*, 12*b*, in the event metering cylinders 14 are advanced in time with relative bottom shells F to be filled with the pharmaceutical product from the other container 12*a*, 12*b*.

A supply-cutoff operating mode will now be described with reference to FIG. 6, with reference to one bottom shell F and container 12*a*, and as of the instant in which solenoid valve 50 of the metering device 13 considered has been activated, and relative cam follower roller 24 has engaged portion 25 of cam 21 associated with container 12*a*.

As wheel 2 rotates about axis 3 (clockwise in FIG. 4), slit 41 associated with actuating cylinder 32 of the device 13 considered engages portion 46*a* of relative channel 45, so that the compressed air along relative conduit 48 first flows through slit 41, then into relative cavity 40, and finally into bottom chamber 33 of cylinder 32.

Figure 6A:
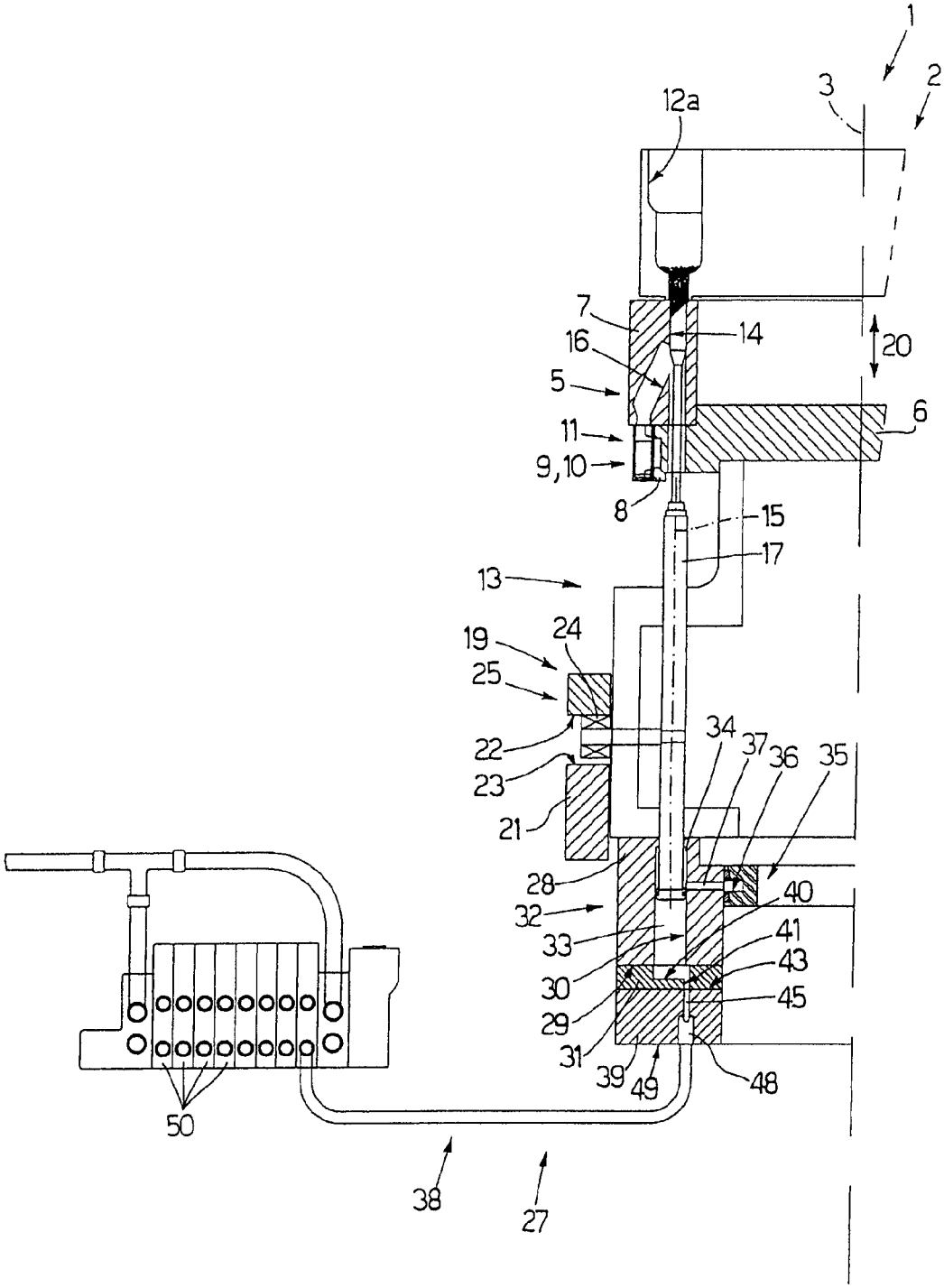
FIGS. 6*a*-6*e* show, schematically, a second operating mode of the FIG. 1 machine.

Chamber 33 having a larger cross section than chamber 34, the upward thrust exerted on piston 17 by the compressed air fed into chamber 33 is greater than the downward thrust exerted on piston 17 by the compressed air fed into chamber 34, so that cam follower roller 24 is moved onto top track 22 of cam 21, and piston 17 into a raised position (FIG. 6*a*).

Figure 6B:
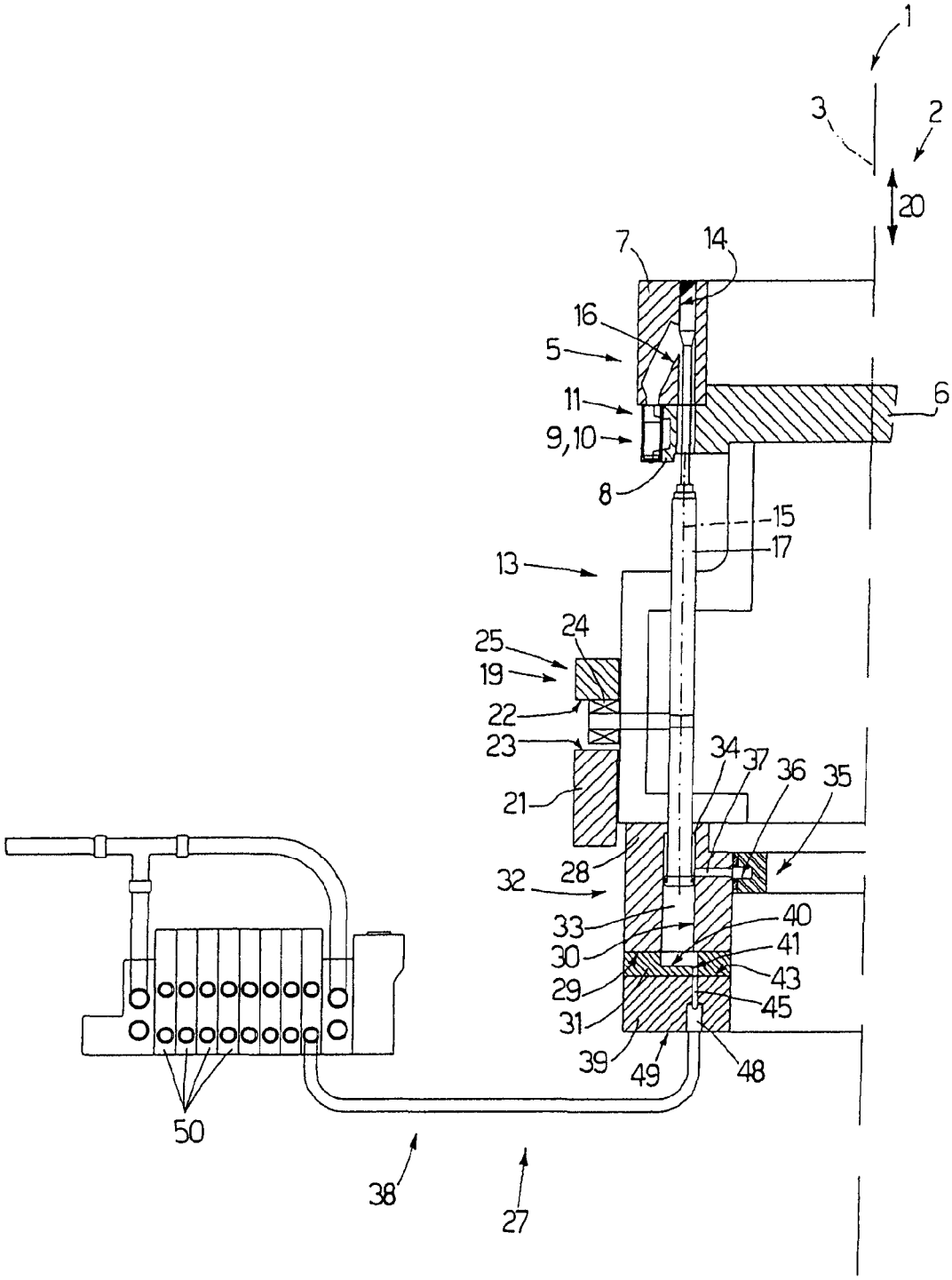

As a result, metering cylinder 14 disengages container 12*a* with a relatively small quantity of pharmaceutical product defined by the slope of top surface 18 of piston 17 with respect to relative axis 15 (FIG. 6*b*).

Figure 6C:
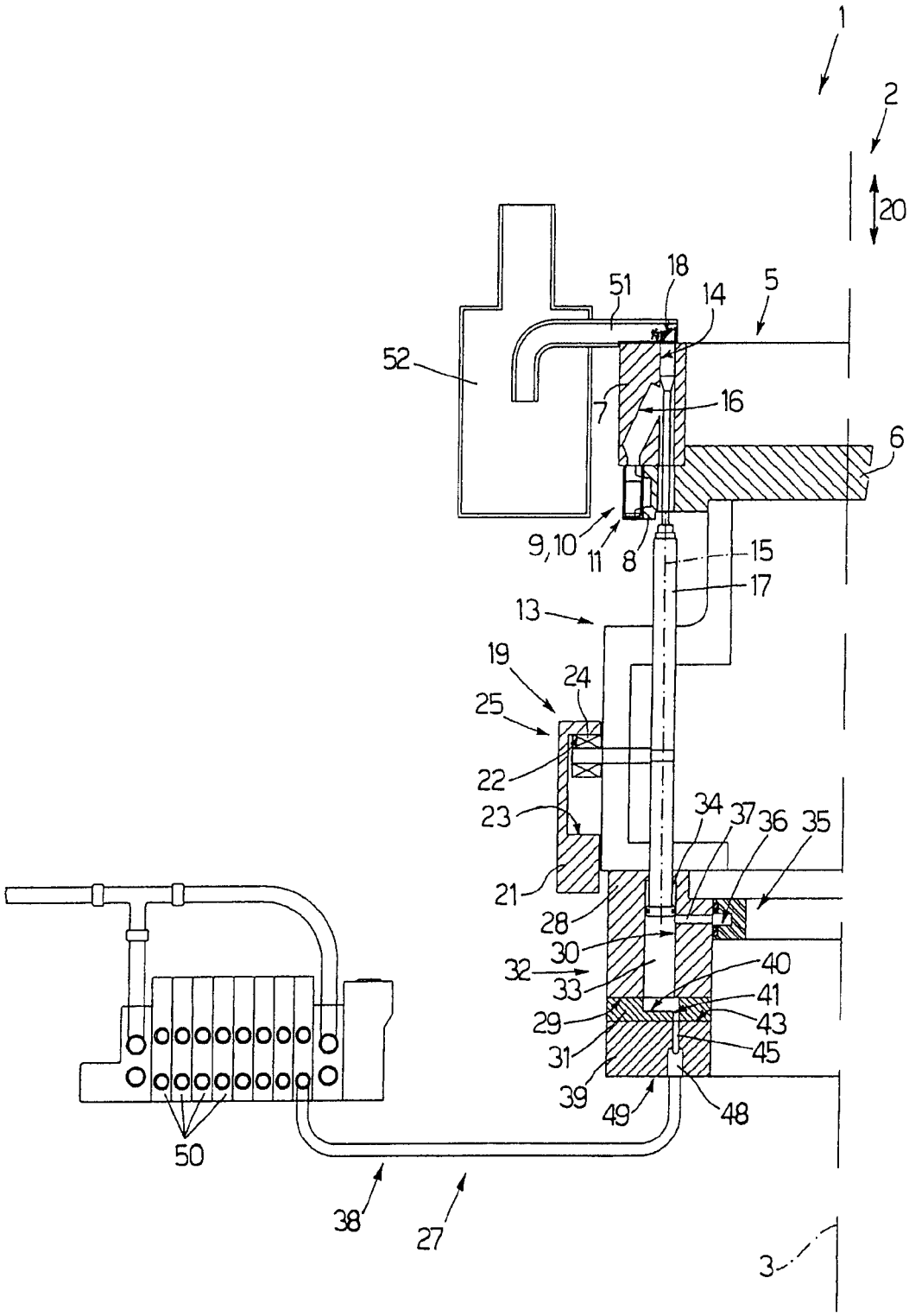

Upon slit 41 engaging portions 46*a* and/or 46*b*, and given the shape of portion 25 of cam 21, piston 17 is raised further and projects from cylinder 14 to expel the pharmaceutical product withdrawn from container 12*a* out of cylinder 14 and connect chamber 33 to conduit 37 (FIG. 6*c*).

Figure 6D:
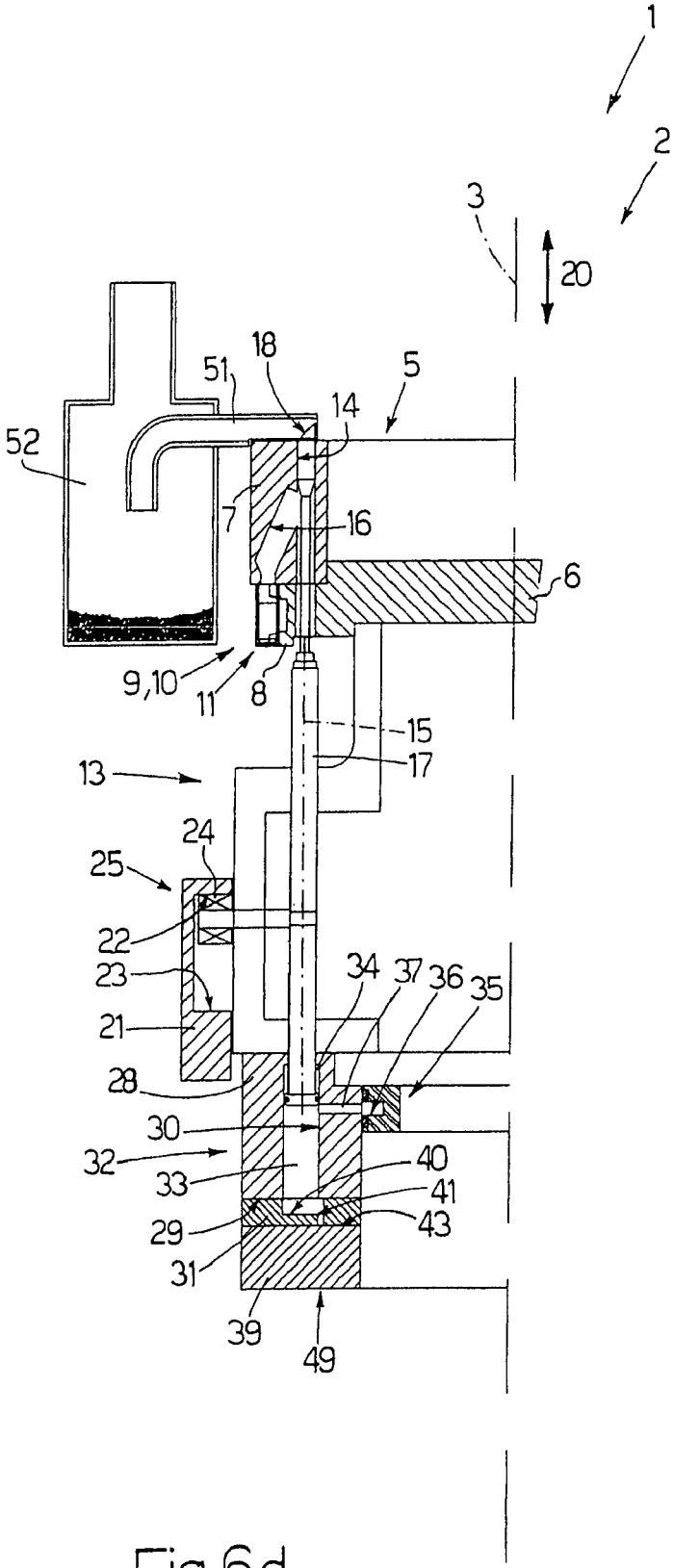
Figure 6E:
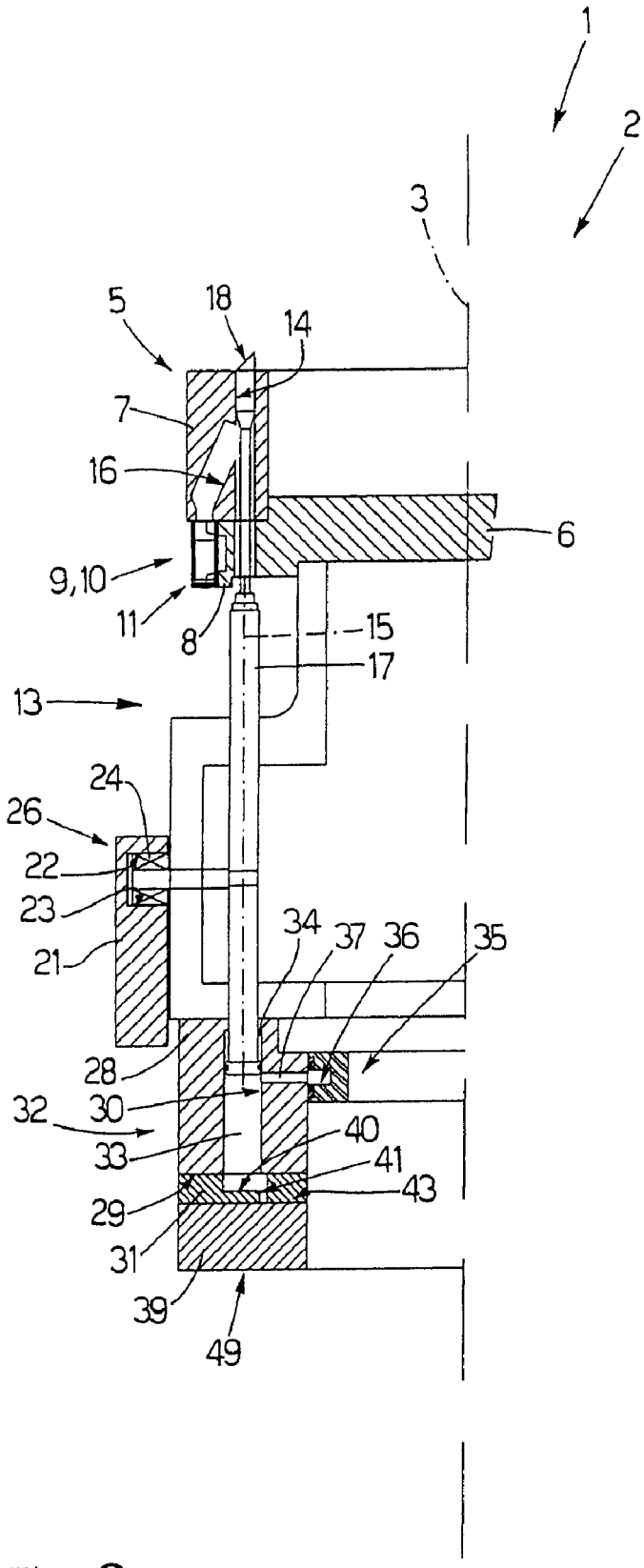

At this point, slit 41 disengages portion 46*b* of relative channel 45, solenoid valve 50 is deactivated, and the pharmaceutical product expelled from cylinder 14 is sucked into a suction conduit 51 of a collecting bin 52 mounted along path P (FIG. 6*d*).

Finally, by combining engagement of portion 26 of cam 21 by cam follower roller 24 (FIG. 6*e*) with activation of solenoid valve 50 of channel 45 in the group 44 of channels 45 associated with container 12*b*, piston 17 is moved back into the FIG. 6*a* position, so that no pharmaceutical product is withdrawn from container 12*b*; whereas, by combining engagement of portion 26 of cam 21 by cam follower roller 24 (FIG. 6*e*) with deactivation of the above solenoid valve 50, piston 17 is moved back into the FIG. 5*a* position to withdraw the pharmaceutical product from container 12*b*.

In connection with the above, it should be pointed out that portion 47, which is circumferentially narrower than the corresponding slits 41, allows each slit 41 to communicate simultaneously with portions 46*a*, 46*b* of relative channel 45. Given two consecutive slits 41 in the same group 42 of slits 41, it is therefore possible to activate solenoid valve 50 of portion 46*b* of relative channel 45 to feed compressed air to the downstream slit 41 in the rotation direction of wheel 2 about axis 3, and at the same time deactivate solenoid valve 50 of portion 46*a* of relative channel 45 to cut off compressed-air supply to the upstream slit 41 in the rotation direction of wheel 2 about axis 3.

From the foregoing it will be appreciated that, although specific embodiments of the invention have been described herein for purposes of illustration, various modifications may be made without deviating from the spirit and scope of the invention.

What is claimed is:

1. A machine for filling containers with at least one granular product, the machine comprising conveying means for feeding each container continuously along a given path; at least one tank containing the product; at least one metering wheel mounted to rotate continuously about a respective substantially vertical longitudinal axis; a number of metering devices traveling with the metering wheel along a portion of said path in time with relative said containers to feed the product into the relative containers, each metering device comprising a metering cylinder for receiving the product from the tank, a drop chute for unloading the product in the metering cylinder into the relative container, and a piston which defines the bottom of the metering cylinder and moves along the metering cylinder, in a direction substantially parallel to said axis, to and from a feed position in which to feed the product to the drop chute; and actuating means for moving the pistons in said direction, the actuating means comprising at least one cam and, for each piston, at least one cam follower cooperating with the cam; and the machine being characterized in that the actuating means also comprise pneumatic push means for maintaining engagement of said cam by the cam followers.

2. A machine as claimed in claim 1, wherein the cam comprises a top track and a bottom track, which are at least partly separated by a distance, measured parallel to said direction, greater than the dimension of a said cam follower, also measured parallel to said direction.

3. A machine as claimed in claim 2, wherein the push means comprise, for each metering device, first and second push means for maintaining the relative said cam follower in contact with said top track and said bottom track respectively.

4. A machine as claimed in claim 3, wherein the push means also comprise pressurized-gas supply means, and, for each metering device, an actuating cylinder; each piston defining an output rod of a relative actuating cylinder, and defining, inside the relative actuating cylinder, a bottom chamber and a top chamber which communicate pneumatically with said supply means.

5. A machine as claimed in claim 4, wherein the bottom chamber is larger in cross section than the top chamber.

6. A machine as claimed in claim 4, wherein said first and second push means respectively comprise a first and second pneumatic circuit for connecting said supply means to the relative said bottom chamber and top chamber respectively.

7. A machine as claimed in claim 6, wherein the second pneumatic circuit connects the supply means continuously to the relative top chamber to normally maintain the relative cam follower in contact with said bottom track.

8. A machine as claimed in claim 6, wherein the first push means also comprise control means for selectively connecting the first pneumatic circuit to the supply means, so as to move the relative cam follower into contact with the top track in opposition to said second push means.

9. A machine as claimed in claim 5, wherein the first push means also comprise a fixed feed disk, and a distributor disk movable with the metering wheel about said axis; the first pneumatic circuit comprising a first portion formed through the feed disk and connectable selectively to said supply means, and a second portion formed through the distributor disk and for connecting the bottom chamber and the first portion.

* * * * *